US011759933B2

(12) United States Patent
Harper

(10) Patent No.: US 11,759,933 B2
(45) Date of Patent: Sep. 19, 2023

(54) HAMMER EXTENDER

(71) Applicant: Rex Harper, Oakland, CA (US)

(72) Inventor: Rex Harper, Oakland, CA (US)

( * ) Notice: Subject to any disclaimer, the term of this patent is extended or adjusted under 35 U.S.C. 154(b) by 228 days.

(21) Appl. No.: 17/033,867

(22) Filed: Sep. 27, 2020

(65) Prior Publication Data

US 2021/0094162 A1 Apr. 1, 2021

Related U.S. Application Data

(60) Provisional application No. 62/973,299, filed on Sep. 28, 2019.

(51) Int. Cl.

| | |
|---|---|
| ***B25D 1/00*** | (2006.01) |
| ***B25G 3/00*** | (2006.01) |
| ***B25D 1/14*** | (2006.01) |
| ***B25D 1/06*** | (2006.01) |
| *B25F 1/00* | (2006.01) |
| *B25G 1/08* | (2006.01) |

(52) U.S. Cl.

CPC ..... *B25D 1/00* (2013.01); *B25D 1/06* (2013.01); *B25D 1/14* (2013.01); *B25G 3/00* (2013.01); *B25D 2250/005* (2013.01); *B25D 2250/025* (2013.01); *B25D 2250/051* (2013.01); *B25D 2250/141* (2013.01); *B25F 1/006* (2013.01); *B25G 1/08* (2013.01)

(58) Field of Classification Search

CPC ... B25D 1/00; B25D 1/02; B25D 1/06; B25D 1/14; B25D 1/16; B25D 2250/005; B25D 2250/025; B25D 2250/051; B25D 2250/121; B25D 2250/141; B25D 2250/275; B25C 3/008; B25F 1/00; B25F 1/006; B25F 1/02; B25F 1/04; B25G 1/00; B25G 1/02; B25G 1/08

See application file for complete search history.

(56) References Cited

U.S. PATENT DOCUMENTS

| | | | | |
|---|---|---|---|---|
| 1,727,904 A | | 9/1929 | Rokos | |
| 3,979,040 A | | 9/1976 | Denin | |
| 4,483,475 A | * | 11/1984 | Whitaker | B25C 1/02 227/147 |
| 4,562,948 A | * | 1/1986 | Floyd | B25C 1/02 227/113 |
| 4,676,424 A | | 6/1987 | Meador et al. | |
| 5,529,234 A | | 6/1996 | Juneau | |

(Continued)

FOREIGN PATENT DOCUMENTS

| | | | |
|---|---|---|---|
| CN | 202556370 | * | 11/2012 |
| EP | 1708852 A2 | | 10/2006 |

(Continued)

*Primary Examiner* — Robert J Scruggs

(57) ABSTRACT

In one example, a system includes a hammer extender having a head formed from an upper layer, a lower layer and a side layer. The hammer extender includes an elongated body portion having a solid core elongated portion and a hollow core elongated portion. One end of the solid core elongated portion is connected to the head, and the other end is connected to the hollow core elongated portion. The hollow core elongated portion can receive and guide a nail during impact. The system may include a hammer having a hammer handle with a hollow interior to store the hammer extender.

16 Claims, 5 Drawing Sheets

(56) References Cited

U.S. PATENT DOCUMENTS

| | | | | |
|---|---|---|---|---|
| 6,553,640 | B1 * | 4/2003 | Estes | B25C 1/02 29/525 |
| 6,951,153 | B2 | 10/2005 | Berthlaume | |
| 8,033,199 | B1 | 10/2011 | Noble | |
| 8,479,612 | B2 | 7/2013 | Sergyeyenko et al. | |
| 10,960,523 | B1 * | 3/2021 | Connors | B25C 3/008 |
| 2004/0245313 | A1 * | 12/2004 | Hall, Jr. | B25C 1/02 227/147 |
| 2005/0126345 | A1 * | 6/2005 | Berthiaume | B25C 3/006 81/44 |
| 2008/0276759 | A1 * | 11/2008 | Kelland | B25D 1/02 81/26 |
| 2010/0154598 | A1 * | 6/2010 | Sergyeyenko | B25D 1/04 254/19 |
| 2010/0263133 | A1 * | 10/2010 | Langan | B25D 1/00 7/143 |
| 2011/0174116 | A1 | 7/2011 | Lin | |

FOREIGN PATENT DOCUMENTS

| | | | |
|---|---|---|---|
| WO | 2005072063 | A2 | 8/2005 |
| WO | 2012163798 | A1 | 12/2012 |
| WO | 2015197848 | A1 | 12/2015 |

* cited by examiner

HAMMER EXTENDER

PRIORITY CLAIM

The present disclosure claims priority to provisional patent application No. 62/973,299 filed Sep. 28, 2019, the disclosure of which is hereby incorporated by reference as if fully set forth herein.

BACKGROUND

Many hammers may have a heavy metal head for driving nails into wood and like materials. This heavy metal head may be mounted at right angles to a solid handle portion. A user may hold the handle portion on one hand so as to strike the heavy metal head onto a nail head to drive the nail into place.

Oftentimes, the space around the work area is sufficiently open so that the user can hold the handle in one hand and easily place the other hand around the nail to hold the nail in place during the striking action. At other times, however, the area around the nail may be confined, tight or cramped so that insufficient room exists for the user to hold the nail in place. In addition, many hammers do not have accessories that facilitate the driving of nails and the like. Even when such accessories may be available, they must be stored separate and apart from the hammer such as in a bag or case. This separate storage can be inconvenient to carry and may increase storage space requirements.

BRIEF DESCRIPTION OF THE DRAWINGS

Examples of the disclosure will be rendered by reference to specific examples which are illustrated in the appended drawings. The drawings illustrate only particular examples of the disclosure and therefore are not to be considered to be limiting of its scope. The principles here are described and explained with additional specificity and detail through the use of the accompanying drawings.

DETAILED DESCRIPTION

Figure 1:
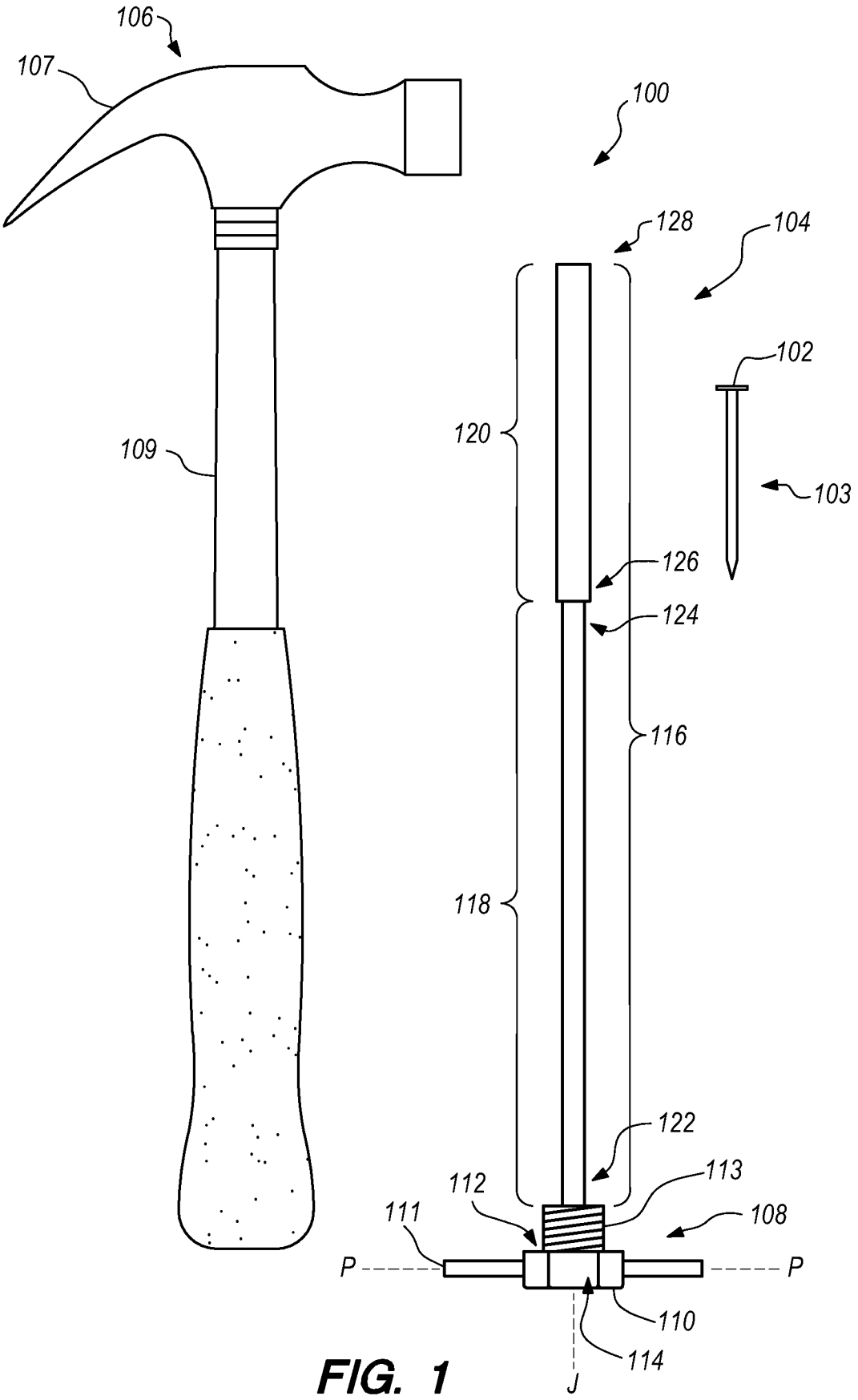
FIG. 1 illustrates an example hammer system according to the present disclosure.

As noted above, the space around a nail to be driven may be confined, tight or cramped so that insufficient room exists for the user to hold the nail in place. In addition, many hammers may not have accessories that facilitate the driving of nails and even when such accessories exist, they must be stored separate and apart from the hammer, which can be inconvenient and may increase storage space requirements.

Accordingly, examples of the present invention provide a hammer system to deliver an impact to a nail head. The hammer system may include a hammer extender to insert into a hammer handle. In this manner, the hammer extender need not be stored separate and apart from the hammer. The hammer and hammer extender are stored as a single unit that saves storage space and is highly convenient.

The hammer extender may have a head and an elongated body portion that includes a solid core elongated portion and a hollow core elongated portion. The head may be formed from three layers such as an upper layer, a lower layer and a side layer. The upper and lower layer may be on parallel plane to each other while the side layer may be between the upper and lower layer.

In some examples, the hammer extender also includes the elongated body portion further described with reference to the figures below. The elongated body portion may have a solid core and a hollow core elongated portion that are concentric. The hollow core elongated portion may be a sleeve to slide upwards or downwards on the solid core elongated portion to receive and guide a nail during impact.

In other examples, the solid core elongated portion may be telescopic, the solid core elongated portion having an interior tubular portion and an exterior tubular portion that are concentric with each other. A first end of the solid core elongated portion may be attached to a first end of the hollow core elongated portion while the other (second) end of the solid core is attached to the head. It is this second end of the hollow core elongated portion that can receive a nail head (and nail). In other examples, the first end of the solid core may include a magnet to attract the nail head and keep said nail upright when the solid core elongated portion is struck. In this manner, the elongated body portion can fit into tight and confined spaces wherein a user's hand would not fit, while the magnetic tip can be used to retain the magnet as the elongated body portion is positioned and inserted into a confined space to a position where a nail can be driven.

According to other examples of the present invention, a hammer may include a handle with a hollow interior. This hollow interior may be shaped to receive and store the hammer extender. In one example, the hammer system may include a magnet attached to the second end of the solid core elongated portion. Here, the magnet attracts the nail head to keep it upright while the solid core elongated portion is struck.

Yet, in other examples of the present invention, a system may include a hammer extender and a hammer having a weighted head and a handle. The hammer extender is to deliver an impact to a nail head. Here, the hammer extender includes a head and an elongated body, where the head is itself attached to a first end of the elongated body portion, and a second end of the elongated body portion may engage the nail head. In some examples, the hammer itself may have a weighted head and a handle, where the handle is hollowed to receive and store the hammer extender. Note that the weighted head of the hammer can deliver an impact to the head of the hammer extender to transmit the impact to the nail head through the elongated body portion.

Figure 2:
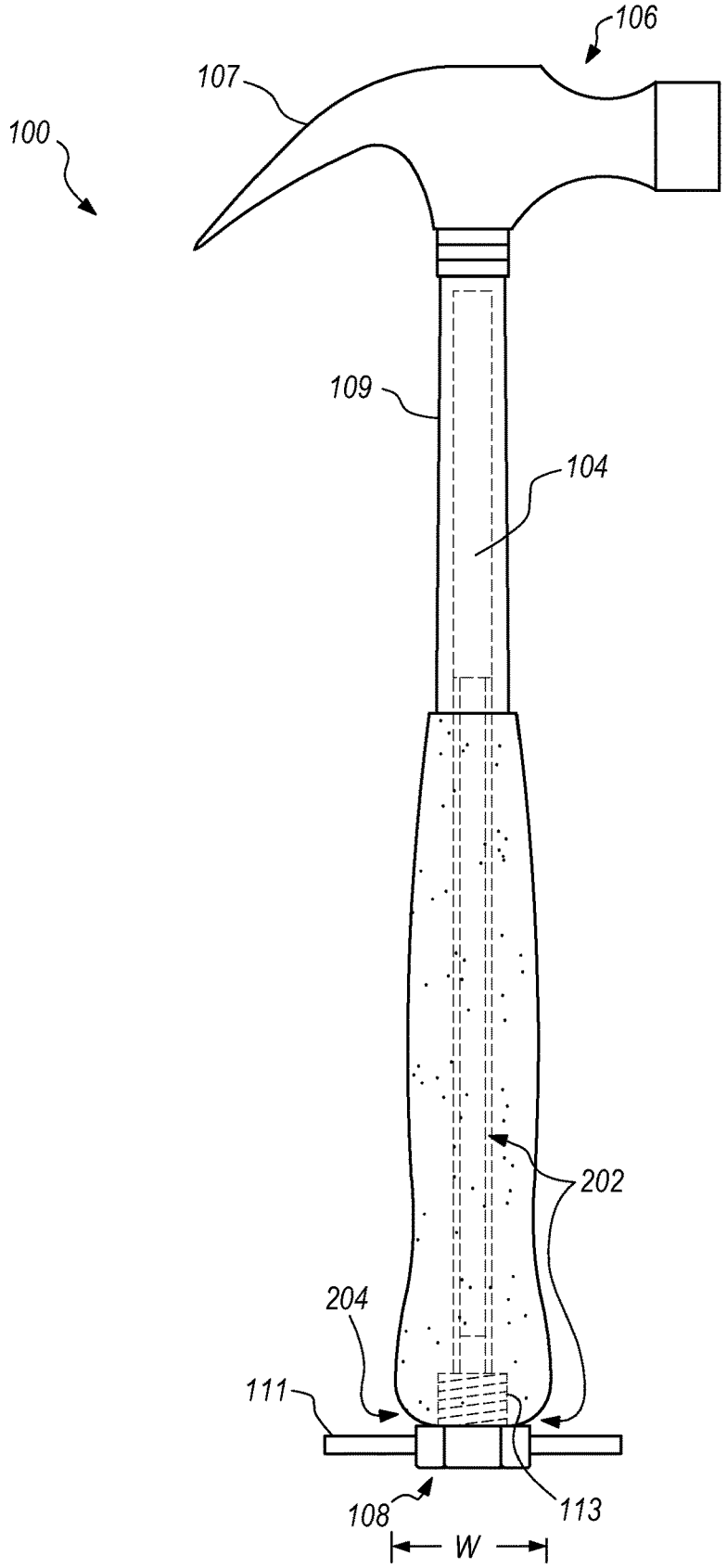
FIG. 2 illustrates an example of a hammer extender stored in a hammer handle according to the present disclosure.

FIGS. 1 and 2 illustrate a hammer system 100 to deliver an impact to a nail head 102 of nail 103. In one example, hammer system 100 may include a hammer extender 104 to insert into a hammer 106. Here, hammer 106 may be a hammer with a weighted head 107 and a hammer handle 109. A user may hold hammer handle 109 to employ weighted head 107 to deliver an impact on nail head 102.

In FIG. 1, hammer extender 104 can receive, withstand and deliver the impact of hammer 106 to nail head 102. Here, hammer extender 104 may include a head 108 formed from an upper layer 110, a lower layer 112 and a side layer 114. In this example, upper layer 110 and lower layer 112 are on a plane P parallel to each other. Side layer 114 is between upper layer 110 and lower layer 112.

In this specific example, head 108 is a hexagonal bolt head, with its lower layer 112 attached to a shank having male threads 113 to mate with corresponding female threads 204 (FIG. 2) at an opening of hollow interior of 202 of hammer handle 109. In this manner, when hammer extender 104 is to be stowed, male threads 113 and female threads 204 can be mated to retain hammer extender 104 within hollow interior 202.

However, male threads 113 and female threads 204 are but examples and need not be employed. Other techniques for retaining hammer extender 104 within the hammer handle may be employed. For example, instead of using threads, a clip hole that extends through the hammer handle can be utilized to insert a clip that can hold hammer extender 104 within the storage space.

Note also that the configuration of head 108 is such that its upper layer 110, its lower layer 112 and its side layer 114 may form a polygon. However, head 108 may be any shape, spiral, flat, oblong, etc., so long as a top area (e.g. upper layer 110) can receive, withstand and transmit the impact of hammer 106.

In some examples, hammer extender 104 further includes an elongated body portion 116 that is comprised of a solid core elongated portion 118 and a hollow core elongated portion 120. A first end 122 of the solid core elongated portion 118 is the shank having male threads 113 attached to lower layer 112 of head 108, and a second end 124 of solid core elongated portion 118 is connected with a first end 126 of hollow core elongated portion 120. In this example, first end 122 may have ¼×20 male threads that can mate into ¼×20 internal female threads on head 108. A second end 128 of hollow core elongated portion 120 is to receive nail head 102 for impact by second end 124 of solid core elongated portion 118.

As noted above, hammer 106 may include weighted head 107 and hammer handle 109. Here, hammer handle 109 may have a hollow interior 202 as illustrated in FIG. 2. In FIG. 2, hammer extender 104 is shown as being stowed for storage within hollow interior 202. In some examples, hollow interior 202 is itself shaped to receive and store hammer extender 104.

As shown in FIG. 1, hammer extender 104 may include an extender handle 11 to attach to head 108. Extender handle 11 may be a rod extending from opposite ends of side layer 114 of head 108. Here, extender handle 11 can be grasped by a user to open or close and lock-in hammer extender 104 in hollow interior 202 (FIG. 2) of hammer handle 109. It is noted that extender handle 111 is substantially orthogonal to a plane J of the elongated body portion.

Figure 3:
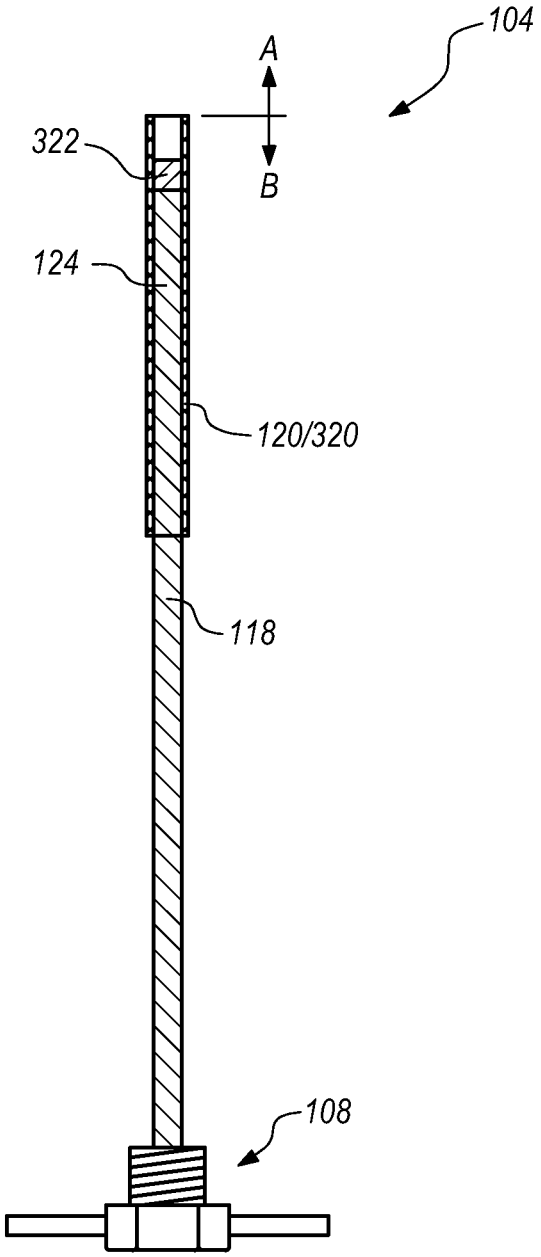
FIG. 3 illustrates an example of a cross-sectional view of a hammer extender along the plane J of FIG. 1 according to the present disclosure.

FIG. 3 illustrates a cross-sectional view of hammer extender 104 along the plane J of FIG. 1. As shown in the example of FIG. 3, hollow core elongated portion 120 (FIG. 1) may be a sleeve 320 (FIG. 3) that can slide on solid core elongated portion 118. Sleeve 320 and solid core elongated portion 118 are concentric. Furthermore, sleeve 320 can slide upwards in direction A (or downwards in direction B depending upon orientation) on solid core elongated portion 118 to receive nail 103 (FIG. 1) and to slide downwards (or upwards depending upon orientation) to retain nail 103 in place during impact.

In FIG. 3, hammer extender 104 may comprise a magnet 322 attached to second end 124 of solid core elongated portion 118. Magnet 322 has substantially the same circumference as solid core elongated portion 118, and in some instances magnet 322 and solid core elongated portion may be attached with a magnetic bit tip holder (not shown). Here, magnet 322 can attract nail head 102 to keep nail 103 upright while solid core elongated portion 118 is struck.

Operation of hammer system 100 will now be described with reference to FIG. 2 and FIG. 4, which illustrates a user 402 during a nail striking operation. Here, user 402 begins by removing hammer extender 104 from its storage location, namely, hollow interior 202 (FIG. 2). In FIG. 2, user 402 may grasp and twist extender handle 111 in an anticlockwise direction to disengage threads 113 from the interior threads (not shown) of hollow interior 202.

Figure 4:
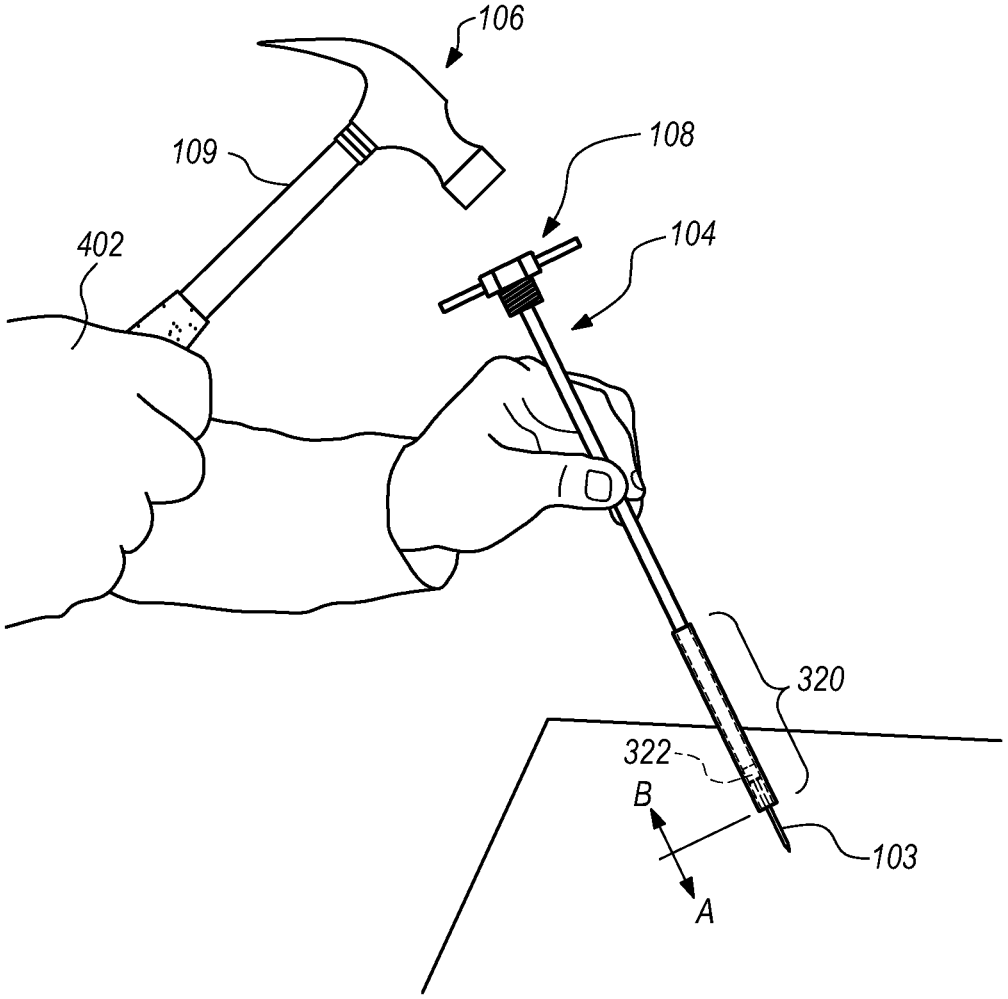
FIG. 4 illustrates an example operation of the hammer extender by a user during a nail striking operation.

Once hammer extender 104 is disengaged, user 402 can then utilize hammer extender 104 for the nail striking operation of FIG. 4. Specifically, in FIG. 4, user 402 slides sleeve 302 in the direction B upward along solid core elongated portion 118 until the tip of magnet 322 can be observed. Magnet 322 is then used to attract/attach nail head 102 (not shown) of nail 103. After nail 103 is attached, sleeve 302 can be lowered and slid in the A direction to cover nail 103 as shown. Hammer extender 104 now having nail 103 attached can then be inserted into a confined space to position the nail at a desired location.

User 402 can then grasp the upper area of hammer extender 104 in one hand, while grasping handle 109 of hammer 106 to strike head 108 of hammer extender 104. The impact is driven along hammer extender 104 and delivered to nail 103 to drive the nail into place without the user having to hold the nail or anywhere near the nail in a confined space.

Once the nail striking operation is completed, hammer extender 104 is returned to its storage location within hollow interior 202 of handle 109. It is noted that unlike any existing system, the span W of head 108 is no larger than the width of bottom handle 109 so the head 108 is compact and can be easily stored therein. In other words, head 108 is not a large plate for the protection of a user's hand as such plates would cause inability to store hammer extender 104 with hammer 106.

In this manner, according to the present invention, the hammer extender need not be stored separate and apart from the hammer. The hammer and hammer extender are stored as a single unit that saves storage space and is highly convenient. In this manner, the elongated body portion can fit into tight and confined spaces wherein a user's hand would not fit, while the magnetic tip can be used to retain the magnet as the elongated body portion is positioned and inserted into a confined space to a position where a nail can be driven.

Figure 5:
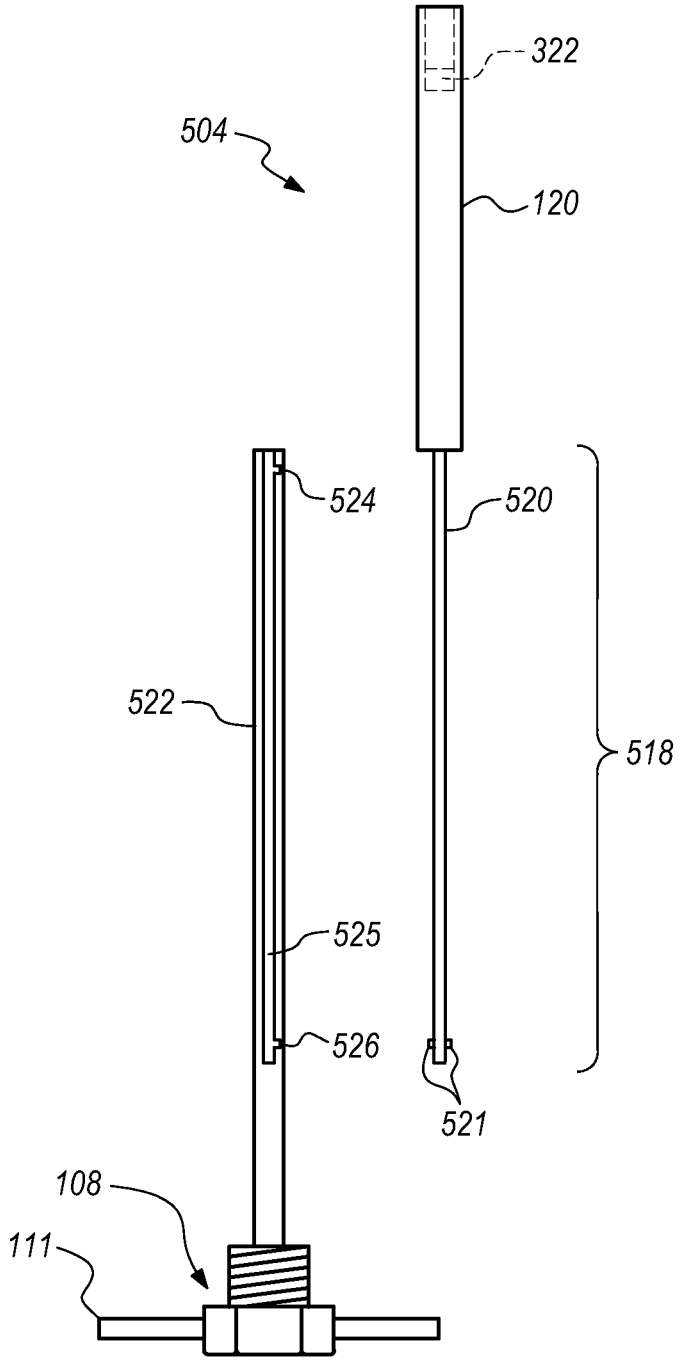
FIG. 5 illustrates an example of a hammer extender according to the present disclosure.

FIG. 5 illustrates an example hammer extender 504 according to the present disclosure. In FIG. 5, unlike hammer extender 104 of FIG. 1 which has a non-retractable solid core elongated portion, hammer extender 504 of this example is telescopic. Specifically, solid core elongated portion 518 is telescopic. Solid core elongated portion 518 includes an interior tubular portion 520 and an exterior tubular portion 522 that are concentric with each other. Interior tubular portion 520 is slidable via groove 525 of exterior tubular portion 522. Interior tubular portion 520 may have pins 521 that lock (when twisted) into corresponding locking notches 524 on the exterior tubular portion 522 when interior tubular portion 520 is raised or extended to be telescopic. The same pins 521 also lock into locking notches 522 of exterior tubular portion 522 when interior tubular portion 520 is lowered or retracted. In this manner, when user 402 (FIG. 4) encounters a confined space that requires further extension, the user can easily extend the reach of hammer extender 504 in accordance an example of this disclosure.

Although a variety of examples and other information was used to explain aspects within the scope of the appended claims, no limitation of the claims should be implied based on particular features or arrangements in such examples.

While the above description is a complete description of specific examples of the disclosure, additional examples are also possible. Thus, the above description should not be taken as limiting the scope of the disclosure which is defined by the appended claims along with their full scope of equivalents.

I claim:

1. A hammer system to deliver an impact to a nail head, the hammer system comprising:

a hammer extender to insert into a hammer, the hammer extender having a head formed from an upper layer, a lower layer and a side layer, the upper and lower layer being on a parallel plane to each other, the side layer being between the upper and lower layer, an elongated body portion that is comprised of a solid core elongated portion and a hollow core elongated portion, wherein a first end of the solid core elongated portion is a shank with male threads, the shank attached to the lower layer of the head, and a second end of the solid core elongated portion is connected with a first end of the hollow core elongated portion, wherein a second end of the hollow core elongated portion is to receive a nail head for impact by the second end of the solid core elongated portion and wherein the solid core elongated portion is co-axial with the hollow core elongated portion;

the hammer having a hammer handle with a hollow interior, wherein the hollow interior is shaped to receive and store the hammer extender; and wherein the head and the shank with the male threads of the solid core elongated portion is releasably attached to mate with corresponding female threads at an opening of the hollow interior of the hammer handle.

2. The hammer system of claim 1 further comprising a magnet attached to the second end of the solid core elongated portion, wherein the magnet is to attract the nail head.

3. The hammer system of claim 1 further comprising an extender handle to attach to the head, wherein the extender handle is a rod extending from opposite ends of the side layer of the head, wherein the extender handle is to open or close the hammer extender in the hollow interior of the hammer handle.

4. The hammer system of claim 1 wherein the hollow core elongated portion is a sleeve to linearly slide on the solid core elongated portion, wherein the sleeve and the solid core elongated portion are concentric.

5. The hammer system of claim 4 wherein the sleeve is to slide upwards on the solid core elongated portion to receive a nail and to slide downwards to retain the nail in place during impact.

6. The hammer system of claim 1 wherein the first end of the solid core portion includes male threads that mate with female threads included in the inner opening of the lower layer of the head to form said releasable attachment.

7. A system comprising:

a hammer extender having a head formed from an upper layer, a lower layer and a side layer, the upper and lower layer being on a parallel plane to each other, the side layer being between the upper and lower layer, and an elongated body portion having a solid core elongated portion and a hollow core elongated portion, wherein a first end of the solid core elongated portion is a shank with male threads, the shank attached to the lower layer of the head, and a second end of the solid core elongated portion is connected with a first end of the hollow core elongated portion, wherein the first end of the solid core portion comprising the head and the shank with the male threads of the solid core elongated portion is releasably attachable to mate with corresponding threads at an opening of the hollow interior of the hammer handle, wherein the hollow core elongated portion is to slide upwards or downwards on the solid core elongated portion to receive a nail and to guide said nail during impact.

8. The system of claim 7, wherein the hollow interior of the hammer is shaped to receive and store the hammer extender.

9. The system of claim 7 further comprising a magnet attached to the second end of the solid core elongated portion, wherein the magnet is to attract a nail head of the nail.

10. The system of claim 7 further comprising an extender handle to attach to the head, wherein the extender handle is a rod extending from opposite ends of the side layer of the head.

11. The system of claim 7 wherein the solid core elongated portion is telescopic, the solid core elongated portion having an interior tubular portion and an exterior tubular portion, concentric with each other.

12. The system of claim 7 wherein the first end of the solid core portion includes male threads that mate with female threads included in the inner opening of a lower layer of the head to form said releasable attachment.

13. A system comprising:

a hammer extender to deliver an impact to a nail head, the hammer extender including a head and an elongated body, wherein the head formed from an upper layer, a lower layer and a side layer, the upper and lower layer being on a parallel plane to each other, the side layer being between the upper and lower layer, wherein the head is attached to a first end of the elongated body portion, and a second end of the elongated body portion is to engage a nail with the nail head, wherein the first end of the elongated body portion is a shank with male threads, the shank attached to the lower layer of the head, and a second end of the elongated body portion is connected with a first end of a hollow core elongated portion, wherein the first end of the solid core portion comprising the head and the shank is releasably attachable to mate with corresponding threads at an opening of the hollow interior of the hammer handle; and a hammer having a weighted head and a handle, wherein the handle is hollowed to receive and store the hammer extender, wherein the weighted head is to deliver the impact to the head of the hammer extender to transmit the impact to the nail head through the elongated body portion.

14. The system of claim 13 further comprising a magnet attached to the second end of the elongated body portion, wherein the magnet is to attract the nail head.

15. The system of claim 13 wherein the elongated body includes an interior tubular portion and an exterior tubular portion that are telescopic.

16. The hammer system of claim 13 wherein the first end of the solid core portion includes male threads that mate with female threads included in the inner opening of the lower layer of the head to form said releasable attachment.

* * * * *